US010167684B2

(12) United States Patent
Steele

(10) Patent No.: US 10,167,684 B2
(45) **Date of Patent: *Jan. 1, 2019**

(54) HIGH PRESSURE MULTIBORE JUNCTION ASSEMBLY

(71) Applicant: Halliburton Energy Services, Inc., Houston, TX (US)

(72) Inventor: David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 671 days.

This patent is subject to a terminal disclaimer.

(21) Appl. No.: 14/019,184

(22) Filed: Sep. 5, 2013

(65) Prior Publication Data

US 2014/0000914 A1 Jan. 2, 2014

Related U.S. Application Data

(63) Continuation of application No. 13/152,892, filed on Jun. 3, 2011, now Pat. No. 8,701,775.

(51) Int. Cl.
*E21B 41/00* (2006.01)
*E21B 17/18* (2006.01)

(52) U.S. Cl.
CPC ..... *E21B 17/18* (2013.01); *E21B 41/0035* (2013.01)

(58) Field of Classification Search
USPC ..... 166/313, 50, 242.3
See application file for complete search history.

(56) References Cited

U.S. PATENT DOCUMENTS 5,454,430 A * 10/1995 Kennedy et al. ..... 166/50
5,685,373 A * 11/1997 Collins ..... E21B 7/043 125/5
5,960,873 A 10/1999 Alexander
6,019,173 A * 2/2000 Saurer et al. ..... 166/98
2001/0009189 A1 7/2001 Brooks et al.
2004/0238172 A1 12/2004 Collins et al.
2005/0061511 A1 3/2005 Steele

OTHER PUBLICATIONS

Tanya Hanham, Requisition by the Examiner in Accordance with Subsection 30(2) of the Patent Rules, Canadian Patent Application No. 2,837,951, Jul. 29, 2015, 3 pages Canadian Intellectual Property Office, Canada.
Susan Morrish, Extended Search Report, European Patent Application No. 12793833, dated Sep. 7, 2015, 7 pages, European Patent Office, Munich Germany.

(Continued)

*Primary Examiner* — D. Andrews
*Assistant Examiner* — Ronald R Runyan
(74) *Attorney, Agent, or Firm* — Kilpatrick Townsend & Stockton LLP

(57) ABSTRACT

A high pressure multibore junction assembly and method for completion of a lateral wellbore using a high pressure multibore junction assembly, which comprises a tubular main leg and a tubular lateral leg. The tubular main leg is secured within a main wellbore and the tubular lateral leg is positioned through a lateral wellbore. The tubular main leg and the tubular lateral leg may be stabilized relative to each other as the multibore junction assembly is lowered into the main wellbore.

24 Claims, 2 Drawing Sheets

(56) References Cited

OTHER PUBLICATIONS

Commissioner; International Preliminary Report on Patentability; PCT/US12/37493; dated Dec. 19, 2013; 7 pgs.; ISA/KR.
Cheng, Weifeng; Office Action for Australian Patent Application No. 2012262875; Australian Government; Nov. 1, 2013; 4 pgs.
Response to Office Action for Australian Patent Application No. 2012262875; Callinans; dated Dec. 2, 2013; 17 pgs.
Lu, Yan; Office Action for Chinese Patent Application No. 201280027354.4; The State Intellectual Property Office of the People's Republic of China; dated Sep. 3, 2014; 5 pgs.
Response to Office Action for Chinese Patent Application No. 201280027354.4; Lungtin International Intellectual Property Agent Ltd.; dated Jan. 19, 2015; 7 pgs.
Response to Examiner's Requisition for Canadian Patent Application No. 2,837,951; Norton Rose Fulbright; dated Mar. 26, 2015; 5 pgs.
Cheng, Weifeng; Office Action for Australian Patent Application No. 2014201241; Australian Government; dated May 7, 2015; 3 pgs.
Response to Office Action for Australian Patent Application No. 2012262875; Callinans; dated Jul. 29, 2015; 2 pgs.
Brendan Browne; First Examination Report; dated Apr. 28, 2016; 3 pages; Patent Application No. 2016200060; Australian Patent Office; Australia.
Lyskov, A. A.; First Office Action; dated Sep. 5, 2016; 5 pages Patent Application No. 2015126295/03; FIIP; St. Petersburg, Russia.
Li, Caiqin; 2nd Office Action; dated Aug. 1, 2016; 13 pages; Patent Application No. 201410264233.2; SIPO; China.

* cited by examiner

HIGH PRESSURE MULTIBORE JUNCTION ASSEMBLY

CROSS-REFERENCE TO RELATED APPLICATIONS

The priority of U.S. patent application Ser. No. 13/152,892, filed on Jun. 3, 2011, is hereby claimed and the specifications thereof are incorporated herein by reference.

STATEMENT REGARDING FEDERALLY SPONSORED RESEARCH

Not applicable.

FIELD OF THE INVENTION

The present invention generally relates to a high pressure multibore junction assembly and methods for completion of a lateral wellbore using the high pressure multibore junction assembly.

BACKGROUND OF THE INVENTION

Wellbores are typically drilled using a drilling string with a drill bit secured to the lower free end and then completed by positioning a casing string within the wellbore and cementing the casing string in position. The casing increases the integrity of the wellbore and provides a flow path between the surface and selected subterranean formation for the injection of treating chemicals into the surrounding formation to stimulate production, for receiving the flow of hydrocarbons from the formation, and for permitting the introduction of fluids for reservoir management or disposal purposes.

A multibore junction assembly is typically used during completion of a lateral wellbore for producing oil and gas after completion of the lateral wellbore. During the final stages of completion of the lateral wellbore, a multibore junction assembly is lowered into the wellbore on the drill string to a depth where the lateral wellbore extends away from the main wellbore. The multibore junction assembly typically includes a main leg and a lateral leg. The multibore junction assembly therefore, may be secured by a main leg stabbing into a completion deflector. The lateral leg of the multibore junction assembly may then be positioned through the lateral wellbore for completion and production operations. Examples of a multibore junction assembly include Halliburton's FlexRite® and SealRite® products. However, most commercially available products, like FlexRite® and SealRite®, either do not permit reentry into both the main leg and the lateral leg for completion and production operations or they cannot withstand wellbore pressures above 5400 psi because of their design and/or construction.

SUMMARY OF THE INVENTION

The present invention overcomes one or more of the prior art disadvantages by using a high pressure multibore junction assembly with main leg and lateral leg reentry capability to complete a lateral wellbore under high pressure conditions.

In one embodiment the present invention includes a high-pressure multibore junction assembly, comprising: i) a body with an upper end and a lower end; ii) a tubular main leg with an opening at one end for entry by a tool or another tool, wherein the one end of the main leg is threadably connected to the lower end of the body and increases a high-pressure rating for the multibore junction assembly; iii) a tubular lateral leg with an opening at one end for entry by the tool or the another tool and another opening at another end, wherein the one end of the lateral leg is threadably connected to the lower end of the body and increases the high-pressure rating for the multibore junction assembly, and iv) a stabilizer connected to the main leg or the lateral lea with an opening for receipt of the main leg or the lateral leg.

In another embodiment, the present invention includes a high-pressure multibore junction assembly, comprising: i) a body with an upper end and a lower end; ii) a tubular main leg with an opening at one end for entry by a tool or another tool, wherein the main leg includes a wall with a thickness based on an outside diameter of the body that increases a high-pressure rating for the multibore junction assembly; iii) a tubular lateral leg with an opening at one end for entry by the tool or the another tool and another opening at another end, wherein the lateral leg includes a wall with a thickness based on an outside diameter of the body that increases the high-pressure rating for the multibore junction assembly; and iv) a stabilizer connected to the main leg or the lateral leg with an opening for receipt of the main leg or the lateral leg.

In yet another embodiment, the present invention includes a method for completion of a lateral wellbore, comprising: i) lowering a multibore junction assembly into a main wellbore to a depth at which the pressure in the main wellbore is about or greater than 6,000 PSI, the multibore junction assembly comprising a tubular main leg and a tubular lateral leg; ii) securing the main leg within the main wellbore; iii) positioning the lateral leg through the lateral wellbore; and iv) entering the main leg or the lateral leg with a tool.

These and other objects, features and advantages of the present invention will become apparent to those skilled in the art from the following description of the various embodiments and related drawings.

BRIEF DESCRIPTION OF THE DRAWINGS

The invention will be described with reference to the accompanying drawings, in which like elements are referenced with like reference numbers, and in which.

DETAILED DESCRIPTION OF THE PREFERRED EMBODIMENTS

In the following detailed description of the preferred embodiments, references to the accompanying drawings that form a part hereof, and in which is shown by way of illustration specific preferred embodiments in which the invention may be practiced. These embodiments are described in sufficient detail to enable those skilled in the art to practice the invention, and it is to be understood that other embodiments that may be utilized and that logical changes may be made without departing from the spirit and scope of the present invention. The claimed subject matter thus, might also be embodied in other ways, to include structures, steps and combinations similar to the ones described herein, in conjunction with other present or future technologies. The following detailed description is therefore, not to be taken in a limiting sense, and the scope of the present invention is defined only by the appended claims.

Figure 1A:
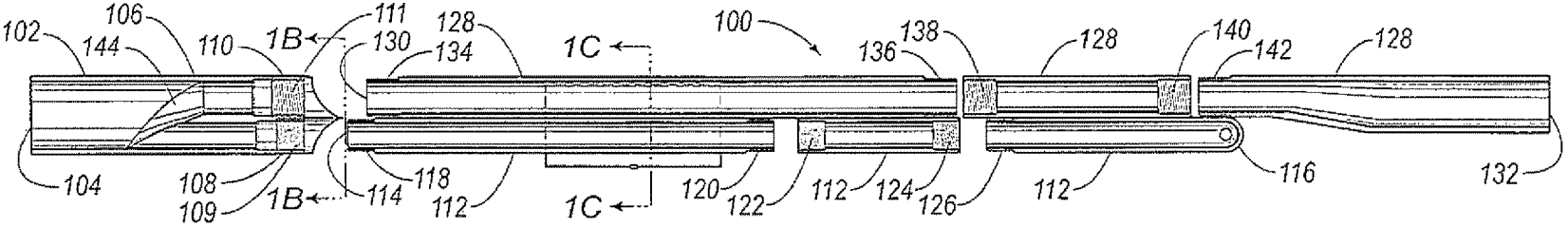
FIG. 1A is a cross-sectional view illustrating one embodiment of a high pressure multibore junction assembly according to the present invention.
Figure 1B:
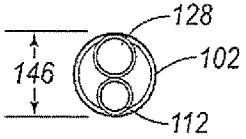
FIG. 1B is a cross-sectional view of the high pressure multibore junction assembly along 1B-1B in FIG. 1A

Referring now to FIG. 1A, a cross-sectional view of one embodiment of a high-pressure multibore junction assembly 100 is illustrated. The multibore junction assembly 100 includes a body 102, a main leg 112 and a lateral leg 128. The body 102 includes an upper end 104, a lower end 106 and an outside diameter 146, which is illustrated in FIG. 1B. The lower end 106 of the body 102 includes a main leg receptacle 108 with internal threads 109 and a lateral leg receptacle 110 with internal threads 111. The threaded connections for the various components of the high-pressure multibore junction assembly embodiments described herein are oriented, but are not limited to the particular internal threads or external threads described for each component and may include internal threads instead of external threads or external threads instead of internal threads based upon the preferred construction of the components for each embodiment.

The main leg 112 includes an opening 114 at one end for entry by a tool and is closed at another end 116. The main leg 112 also includes an inside diameter, an outside diameter and a wall with a thickness based on the outside diameter 146 of the body 102. External threads 118 at the one end of the main leg 112 make up a threaded connection with the internal threads 109 in the main leg receptacle 108 of the body 102, which may increase a high-pressure rating for the multibore junction assembly 100. The main leg 112 may include multiple components as illustrated in FIG. 1A that include threaded connections between the external threads 120, 126 and the internal threads 122, 124—respectively. The threaded connections for the various components that make up the main leg 112 therefore, may also increase the high-pressure rating for the multibore junction assembly 100. Further, the tubular design and wall of the main leg 112 may further increase the high-pressure rating for the multibore junction assembly 100.

The lateral leg 128 includes an opening 130 at one end for entry by a tool and another opening 132 at another end. The lateral leg 128 also includes an inside diameter, an outside diameter and a wall with a thickness based on the outside diameter 146 of the body 102. External threads 134 at the one end of the lateral leg 128 make up the threaded connection with the internal threads 111 in the lateral leg receptacle 110 of the body 102, which may increase the high pressure rating for the multibore junction assembly 100. The lateral leg 128 may include multiple components as illustrated in FIG. 1A that include threaded connections between the external threads 136, 142 and the internal threads 138, 140—respectively. The threaded connections for the various components that make up the lateral leg 128 therefore, may also increase the high pressure rating for the multibore junction assembly 100. Further, the tubular design and wall of the lateral leg 128 may further increase the high pressure rating for the multibore junction assembly 100. Although the inside diameter of the lateral leg 128 is larger than the inside diameter of the main leg 112, as illustrated in FIG. 1A, the inside diameter of the lateral leg 128 may be smaller than, or the same as, the inside diameter of the main leg 112.

The body 102 of the multibore junction assembly 100 may also include a deflector 144 positioned within the body 102 for selectively directing a tool into the main leg 112 or the lateral leg 128 based upon a diameter of the tool. If the diameter of the tool is smaller than the inside diameter of the main leg 112, then the same tool may be used to enter the opening 114 of the main leg 112 and the opening 130 of the lateral leg 128. In this case, the tool may be directed to enter the opening 114 of the main leg 112 by orienting the multibore junction assembly 100 and/or the tool in a manner so that gravity directs the tool to the lower opening 114 of the main leg 112. If, however, the diameter of the tool is larger than the inside diameter of the main leg 112, then another tool may be preferred to enter only the opening 130 of the lateral leg 128. In this case, the tool traverses the deflector 144 into the opening 130 of the lateral leg 128.

As illustrated in FIG. 1B, which is a cross-sectional view of the high-pressure multibore junction assembly 100 along 1B-1B in FIG. 1A, the combined outside diameter of the main leg 112 and the outside diameter of the lateral leg 128 are no greater than the outside diameter 146 of the body 102. As a result, the multibore junction assembly 100 does not include any welded connections that may impair its ability to freely traverse a wellbore lined with casing.

Figure 1C:
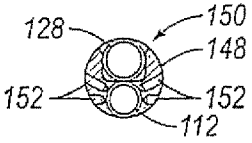
FIG. 1C is a cross-sectional view of the high pressure multibore junction assembly along 1C-1C in FIG. 1A.

As illustrated in FIG. 1C, which is a cross-sectional view of the high-pressure multibore junction assembly 100 along 1C-1C in FIG. 1A, a stabilizer 148 may be connected to the main leg 112 using screws 152, which includes an opening 150 for receipt of the lateral leg 128. Alternatively, the stabilizer may be connected to the lateral leg 128 and include an opening for receipt of the main leg 112.

Figure 2A:
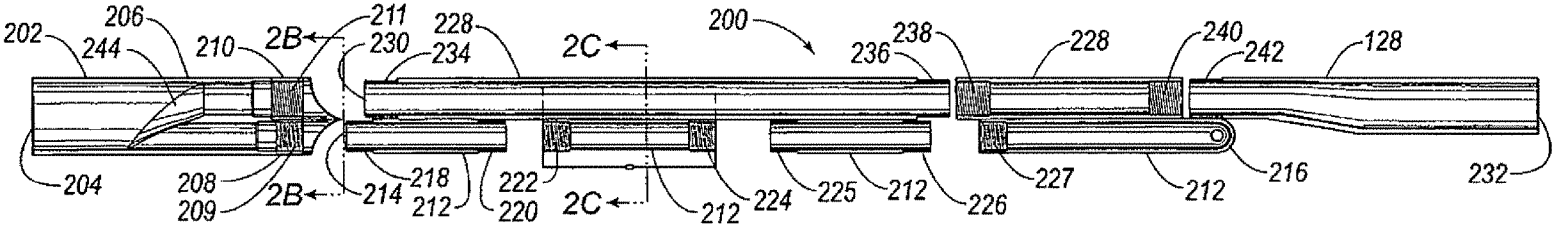
FIG. 2A is a cross-sectional view illustrating another embodiment of a high-pressure multibore junction assembly according to the present invention.

Referring now to FIG. 2A, a cross-sectional view of another embodiment of a high pressure multibore junction assembly 200 is illustrated. The multibore junction assembly 200 includes a body 202, a main leg 212 and a lateral leg 228. The body 202 includes an upper end 204, a lower end 206 and an outside diameter 246, which is illustrated in FIG. 2B. The lower end 206 of the body 202 includes a main leg receptacle 208 with internal threads 209 and a lateral leg receptacle 210 with internal threads 211.

The main leg 212 includes an opening 214 at one end for entry by a tool and is closed at another end 216. The main leg 212 also includes an inside diameter, an outside diameter and a wall with a thickness based on the outside diameter 246 of the body 202. External threads 218 at the one end of the main leg 212 make up a threaded connection with the internal threads 209 and the main leg receptacle 208 of the body 202, which may increase a high pressure rating for the multibore junction assembly 200. The main leg 212 may include multiple components as illustrated in FIG. 2A that include threaded connections between the external threads 220, 225 and the internal threads 222, 224—respectively. Compared to FIG. 1A, the main leg 212 includes additional components with threaded connections between the external threads 226 and the internal threads 227. The threaded connections for the various components that make up the main leg 212 therefore, may also increase the high pressure rating for the multibore junction assembly 200. Further, the tubular design and wall of the main leg 212 may further increase the high pressure rating for the multibore junction assembly 200.

The lateral leg 228 includes an opening 230 at one end for entry by a tool and another opening 232 at another end. The lateral leg 228 also includes an inside diameter, an outside diameter and wall with a thickness based on the outside diameter 246 of the body 202. External threads 234 at the one of the lateral leg 228 make up the threaded connection with the internal threads 211 in the lateral leg receptacle 210 of the body 202, which may increase the high pressure rating for the multibore junction assembly 200. The lateral leg 228 may include multiple components as illustrated in FIG. 2A that include threaded connections between the external threads 236, 242, and the internal threads 238, 240—respectively. The threaded connections for the various components that make up the lateral leg 228 therefore, may also increase the high pressure rating for the multibore junction assembly 200. Further, the tubular design and wall of the lateral leg 228 may further increase the high pressure rating for the multibore junction assembly 200. Although the inside diameter of the lateral leg 228 is larger than the inside diameter of the main leg 212, as illustrated in FIG. 2A, the inside diameter of the lateral leg 228 may be smaller than, or the same as, the inside diameter of the main leg 212.

The body 202 of the multibore junction assembly 200 may also include a deflector 244 positioned within the body 202 for selectively directing a tool into the main leg 212 or the lateral leg 228 based upon a diameter of the tool. If the diameter of the tool is smaller than the inside diameter of the main leg 212, then the same tool may be used to enter the opening 214 of the main leg 212 and the opening 230 of the lateral leg 228. In this case, the tool may be directed to enter the opening 214 of the main leg 212 by orienting the multibore junction assembly 200 and/or the tool in a manner so that gravity directs the tool to the lower opening 214 of the main leg 212. If, however, the diameter of the tool is larger than the inside diameter of the main leg 212, then another tool may be preferred to enter only the opening 230 of the lateral leg 228. In this case, the tool traverses the deflector 244 into the opening 230 of the lateral leg 228.

As illustrated in FIG. 2B, which is a cross-sectional view of the high pressure multibore junction assembly 200 along 2B-2B in FIG. 2B, the combined outside diameter of the main leg 212 and the outside diameter of the lateral leg 228 are no greater than the outside diameter 246 of the body 202. As a result, the multibore junction assembly 200 does not include any welded connections that may impair its ability to freely traverse a wellbore lined with casing.

Figure 2C:
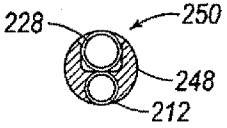
FIG. 2C is a cross-sectional view of the high pressure multibore junction assembly along 2C-2C in FIG. 2A.
Figure 2B:
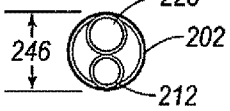
FIG. 2B is a cross-sectional view illustrating another embodiment of a high pressure multibore junction assembly along line 2B-2B in FIG. 2A.

As illustrated in FIG. 2C, which is a cross-sectional view of the high pressure multibore junction assembly 200 along 2C-2C in FIG. 2A, the main leg 212 includes a stabilizer 248 with an opening 250 for receipt of the lateral leg 228. Although this is the preferred embodiment, the lateral leg 228 may include the stabilizer with an opening for receipt of the main leg 212.

Figure 3:
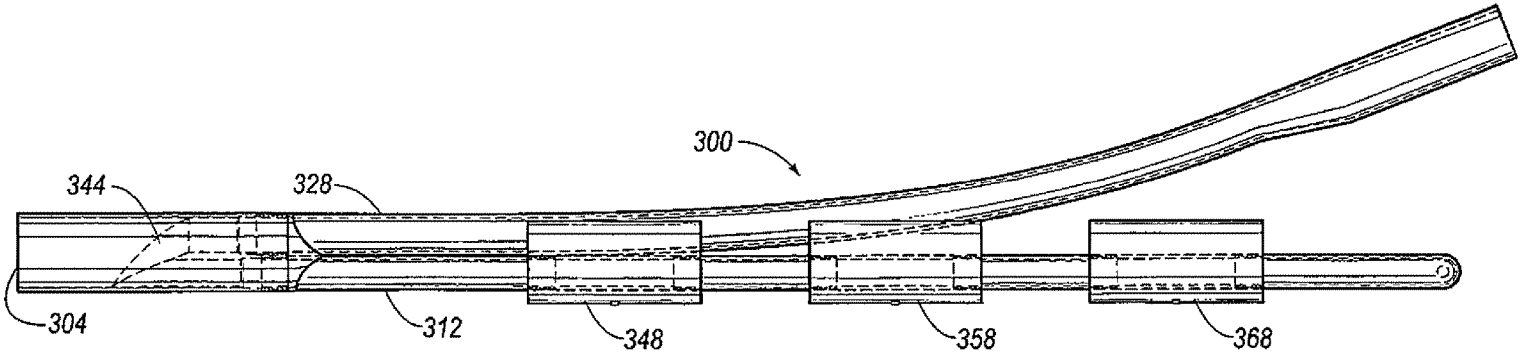
FIG. 3 is a side view illustrating another embodiment of a high pressure multibore junction assembly with multiple stabilizers.

The high pressure multibore junction assembly described herein may be used to complete a lateral wellbore in the following manner described in reference to FIG. 3. The high pressure multibore junction assembly 300 is lowered into a main wellbore to a depth in which the pressure in the main wellbore is about or greater than 6000 psi. The multibore junction assembly 300 includes a substantially tubular main leg 312 and a substantially tubular lateral leg 328. The main leg 312 is secured within the main wellbore using a completion deflector which may be positioned in the main wellbore below the lateral wellbore for securing the main leg 312. The lateral leg 328 is positioned through the lateral wellbore, wherein the main leg 312 and/or the lateral leg 328 may be entered with a tool for completion and production operations. The lateral leg 328 may be selectively entered or reentered with the tool using a deflector 344 to deflect the tool into the lateral leg 328 based upon a diameter of the tool.

The main leg 312 may be stabilized relative to the lateral leg 328 with a stabilizer as the multibore junction assembly 300 is lowered into the main wellbore. In FIG. 3, there are three separate stabilizers, 348, 358, and 368. Stabilizer 348 may be positioned near an upper end 304 of the multibore junction assembly 300. Each stabilizer 348, 358, 368 stabilizes the main leg 312 relative to the lateral leg 328 as the multibore junction assembly 300 is lowered into the main wellbore. Each stabilizer 348, 358, and 368, is connected to the main leg 312 with an opening for receipt of the lateral leg 328. Alternatively, each stabilizer may be connected to the lateral leg 328 with an opening for receipt of the main leg 312 or the main leg 312 may include each stabilizer 348, 358, 368 in the manner described in reference to FIG. 2C. By providing additional stabilizers, the main leg 312 and the lateral leg 328 may be kept in alignment, without buckling, as the multibore junction assembly 300 is rotated and lowered into the main wellbore. Each stabilizer 348, 358, 368 also helps to keep the lateral leg 328 on the top side and the main leg 312 on the bottom side, which is preferred.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the present invention. Therefore, it is manifestly intended that this invention be limited only by the following claims and equivalents thereof.

The invention claimed is:

1. A high-pressure multibore junction assembly, comprising:

a body with an upper end and a lower end;

a tubular main leg with a first orifice at a first end, wherein the first orifice has a first diameter and is adapted to receive a tool, wherein the first end of the tubular main leg is threadably connected to the lower end of the body and increases a high-pressure rating for the multibore junction assembly, wherein the tubular main leg is adapted for positioning within a main wellbore, and wherein the tubular main leg is adapted to facilitate re-entry of the tool into the main wellbore to complete the main wellbore under a pressure condition associated with the high-pressure rating;

a tubular lateral leg with a second orifice at a second end and a third orifice at a third end opposite to the second end, wherein the second orifice has a second diameter and is adapted to receive the tool, wherein the second end of the lateral leg is threadably connected to the lower end of the body and increases the high-pressure rating for the multibore junction assembly, wherein the tubular lateral leg is adapted for positioning within a lateral wellbore, and wherein the tubular lateral leg is adapted to facilitate re-entry of the tool into the lateral wellbore to complete the lateral wellbore under the pressure condition associated with the high-pressure rating; and a stabilizer adapted to entirely surround one of the first diameter of the main leg or the second diameter of the lateral leg, wherein the stabilizer is adapted to be coupled to the tubular main leg or the tubular lateral leg, and wherein the stabilizer is adapted to include an opening that partially surrounds the other one of the first diameter of the main leg or the second diameter of the lateral leg.

2. The multibore junction assembly of claim 1, further comprising a deflector positioned within the body for selectively directing the tool into the lateral leg based upon a diameter of the tool.

3. The multibore junction assembly of claim 1, wherein the main leg includes a wall with a thickness based on an outside diameter of the body that increases the high-pressure rating for the multibore junction assembly.

4. The multibore junction assembly of claim 1, wherein the lateral leg includes a wall with a thickness based on an outside diameter of the body that increases the high-pressure rating for the multibore junction assembly.

5. The multibore junction assembly of claim 1, wherein the body includes an outside diameter, and wherein the combined first diameter of the main leg and the second diameter of the lateral leg being no greater than the outside diameter of the body.

6. The multibore junction assembly of claim 5, wherein the main leg includes an inside diameter and the lateral leg includes an inside diameter.

7. The multibore junction assembly of claim 6, wherein the inside diameter of the lateral leg is larger than the inside diameter of the main leg.

8. The multibore junction assembly of claim 6, wherein the inside diameter of the lateral leg is the same as the inside diameter of the main leg.

9. The multibore junction assembly of claim 1, wherein the main leg includes the stabilizer with an opening for receipt of the lateral leg.

10. A high-pressure multi bore junction assembly, comprising:

a body with an upper end and a lower end, wherein the body has an outer diameter;

a tubular main leg with a first orifice at a first end, wherein the first orifice has a first diameter and is adapted to receive a tool, wherein the main leg includes a wall with a thickness based on the outer diameter of the body that increases a high-pressure rating for the multibore junction assembly, wherein the tubular main leg is adapted for positioning within a main wellbore, and wherein the tubular main leg is adapted to facilitate re-entry of the tool into the main wellbore to complete the main wellbore under a pressure condition associated with the high-pressure rating;

a tubular lateral leg with a second orifice at a second end and a third orifice at a third end opposite to the second end, wherein the second orifice has a second diameter and is adapted to receive the tool, wherein the lateral leg includes a wall with a thickness based on the outer diameter of the body that increases the high-pressure rating for the multibore junction assembly, wherein the tubular lateral leg is adapted for positioning within a lateral wellbore, and wherein the tubular lateral leg is adapted to facilitate re-entry of the tool into the lateral wellbore to complete the lateral wellbore under the pressure condition associated with the high-pressure rating; and a stabilizer adapted to entirely surround one of the first diameter of the main leg or the second diameter of the lateral leg, wherein the stabilizer is adapted to be coupled to the tubular main leg or the tubular lateral leg, and wherein the stabilizer is adapted to include an opening that partially surrounds the other one of the first diameter of the main leg or the second diameter of the lateral leg.

11. The multibore junction assembly of claim 10, further comprising a deflector positioned within the body for selectively directing the tool into the lateral leg based upon a diameter of the tool.

12. The multibore junction assembly of claim 10, wherein the first end of the main leg is threadably connected to the lower end of the body and increases the high-pressure rating for the multibore junction assembly.

13. The multibore junction assembly of claim 10, wherein the second end of the lateral leg is threadably connected to the lower end of the body and increases the high-pressure rating for the multibore junction assembly.

14. The multibore junction assembly of claim 10, wherein the combined first diameter of the main leg and the second diameter of the lateral leg being no greater than the outer diameter of the body.

15. The multibore junction assembly of claim 14, wherein the main leg includes an inside diameter and the lateral leg includes an inside diameter.

16. The multibore junction assembly of claim 15, wherein the inside diameter of the lateral leg is larger than the inside diameter of the main leg.

17. The multibore junction assembly of claim 15, wherein the inside diameter of the lateral leg is the same as the inside diameter of the main leg.

18. The multibore junction assembly of claim 10, wherein the main leg includes the stabilizer with an opening for receipt of the lateral leg.

19. A method for completion of a lateral wellbore, comprising:

drilling a main wellbore;

drilling the lateral wellbore;

lowering a multibore junction assembly into the main wellbore to a depth at which a pressure in the main wellbore is about or greater than 6,000 PSI, the multibore junction assembly comprising a body threadably connected to each of a tubular main leg and a tubular lateral leg, wherein the main leg has a first diameter and the lateral leg has a second diameter;

securing the main leg within the main wellbore;

positioning the lateral leg through the lateral wellbore;

entering the main leg or the lateral leg with a tool;

completing the lateral wellbore by re-entering the tool through the lateral leg into the lateral wellbore, the completion of the lateral wellbore being performed at the pressure of about or greater than 6,000 PSI;

and stabilizing the main leg relative to the lateral leg with a stabilizer as the multibore junction assembly is lowered into the main wellbore, wherein the stabilizer is adapted to be coupled to the tubular main leg or the tubular lateral leg, wherein the stabilizer entirely surrounds one of the first diameter or the second diameter and partially surrounds the other one of the first diameter or the second diameter.

20. The method of claim 19, wherein the lateral leg is selectively entered with the tool using a deflector to deflect the tool into the lateral leg based upon a diameter of the tool.

21. The method of claim 19, further comprising positioning a completion deflector in the main wellbore below the lateral wellbore for securing the main leg.

22. The method of claim 19, wherein the stabilizer is connected to the main leg or the lateral leg and includes an opening for receipt of the main leg or the lateral leg.

23. The method of claim 19, wherein the main leg includes the stabilizer and the stabilizer includes an opening for receipt of the lateral leg.

24. The method of claim 19, further comprising positioning the stabilizer near an upper end of the multibore junction assembly.

* * * * *